US009528363B2

(12) United States Patent
Heidecke et al.

(10) Patent No.: US 9,528,363 B2
(45) Date of Patent: Dec. 27, 2016

(54) VOLUME SYNCHRONIZER FOR TUBULAR HANDLING TOOLS

(71) Applicant: Weatherford Technology Holdings, LLC, Houston, TX (US)

(72) Inventors: Karsten Heidecke, Houston, TX (US); Bjoern Thiemann, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 348 days.

(21) Appl. No.: 14/091,230

(22) Filed: Nov. 26, 2013

(65) Prior Publication Data

US 2015/0144325 A1 May 28, 2015

(51) Int. Cl.

| | |
|---|---|
| ***E21B 19/10*** | (2006.01) |
| ***E21B 44/02*** | (2006.01) |
| ***E21B 19/00*** | (2006.01) |

(52) U.S. Cl.

CPC ..... *E21B 44/02* (2013.01); *E21B 19/00* (2013.01); *E21B 19/10* (2013.01)

(58) Field of Classification Search

CPC ..... E21B 19/10; E21B 19/00; E21B 44/02; F15B 11/22; F15B 2211/782

See application file for complete search history.

(56) References Cited

U.S. PATENT DOCUMENTS 2,351,887 A 6/1944 Steadman
3,643,725 A * 2/1972 Fismer ..... B22C 19/04 164/213
4,161,229 A * 7/1979 Mifsud ..... G01V 1/047 181/114
4,241,581 A 12/1980 Chace
4,351,153 A * 9/1982 Kosmala ..... F15B 11/0365 60/581
4,624,126 A 11/1986 Avila et al.
6,089,338 A 7/2000 Bouligny, Jr.
6,394,201 B1 5/2002 Feigel, Jr. et al.
7,269,949 B1 * 9/2007 Petricio Yaksic ..... F15B 11/22 100/258 R (Continued)

FOREIGN PATENT DOCUMENTS

CN 203052682 U 7/2013

OTHER PUBLICATIONS

Australian Patent Examination Report dated Nov. 4, 2015, for Australian Application No. 201465131.

(Continued)

*Primary Examiner* — Daniel P Stephenson
(74) *Attorney, Agent, or Firm* — Patterson & Sheridan LLP

(57) ABSTRACT

A control system is configured to actuate a tubular handling tool. The system includes a fluid source and a tubular handling tool having a plurality of piston cylinders and a plurality of slips configured to engage a tubular string. The system also includes a volume synchronizer having a plurality of first chambers in fluid communication with the fluid source, a plurality of second chambers in fluid communication with the piston cylinders, a piston separating each of the first and second chambers, and a rod member connected to each piston. Pressurized fluid supplied to the first chambers simultaneously moves each of the pistons to simultaneously force pressurized fluid out of the second chambers and into the piston cylinders to actuate the slips into engagement with the tubular string.

21 Claims, 6 Drawing Sheets

(56) References Cited

U.S. PATENT DOCUMENTS

| | | | | |
|---|---|---|---|---|
| 7,322,190 | B2 * | 1/2008 | Bair | F15B 11/22 60/546 |
| 7,603,942 | B1 * | 10/2009 | Hanser | F15B 11/22 60/546 |
| 7,926,410 | B2 * | 4/2011 | Bair | F15B 11/22 60/484 |
| 7,980,298 | B2 * | 7/2011 | Halse | E21B 19/10 166/75.14 |
| 8,678,112 | B2 * | 3/2014 | Vatne | E21B 19/10 166/75.14 |
| 2004/0020197 | A1 * | 2/2004 | Cray | F15B 11/22 60/485 |
| 2012/0152530 | A1 | 6/2012 | Wiedecke et al. | |
| 2015/0144325 | A1 * | 5/2015 | Heidecke | E21B 19/00 166/77.4 |

OTHER PUBLICATIONS

Canadian Office Action dated Dec. 29, 2015, for Canadian Patent Application No. 2,871,397.
Australian Patent Examination Report dated Aug. 11, 2016, for Australian Application No. 2014265131.
European Search Report dated Jun. 29, 2016 for Application No. 141934372; 9 total pages.

* cited by examiner

VOLUME SYNCHRONIZER FOR TUBULAR HANDLING TOOLS

BACKGROUND OF THE INVENTION

Field of the Invention

Embodiments of the invention generally relate to a control system for synchronizing the supply of a volume of fluid to a tubular handling tool.

Description of the Related Art

The handling of tubular strings has traditionally been performed with the aid of a spider and/or an elevator. Typically, spiders and elevators include a plurality of slips that are disposed about the inner circumference of a housing, also known as a bowl. The slips include teeth that grip the tubular string. The inner surface of the housing is inclined so that the slips may be moved downwardly and radially inward into engagement with the tubular string, and may be moved upwardly and radially outward out of engagement with the tubular string.

To ensure that the tubular string is properly supported, it is important that the slips engage the tubular string uniformly about its circumference. The slips are generally positioned symmetrically around the tubular string. However, as the slips are moved into engagement with the tubular string, one slip may contact the tubular before another slip, and thereby move the tubular string into a slightly off-center position.

There is a need, therefore, for a method and apparatus of synchronizing the slip movement of a tubular handling tool.

SUMMARY OF THE INVENTION

In one embodiment, a control system may comprise a fluid source; a tubular handling tool having a plurality of piston cylinders and a plurality of slips configured to engage a tubular string; and a volume synchronizer. The volume synchronizer comprises a plurality of first chambers in fluid communication with the fluid source; a plurality of second chambers in fluid communication with the piston cylinders; a piston separating each of the first and second chambers; and a rod member connected to each piston. Pressurized fluid supplied to the first chambers simultaneously moves each of the pistons to simultaneously force pressurized fluid out of the second chambers and into the piston cylinders of the tubular handling tool to actuate the slips into engagement with the tubular string.

In one embodiment, a control system may comprise a tubular handling tool having a plurality of piston cylinders and a plurality of slips configured to engage a tubular string; and a volume synchronizer. The volume synchronizer comprises a first piston cylinder having a piston connected to a first rod member; a plate member connected to the first rod member; and a plurality of second piston cylinders, each having pistons connected to the plate member by a plurality of second rod members. Pressurized fluid supplied to the first piston cylinder moves the plate member to move each of the pistons in the second piston cylinders to simultaneously force pressurized fluid out of the second piston cylinders and into the piston cylinders of the tubular handling tool to actuate the slips into engagement with the tubular string.

In one embodiment, a method of actuating a tubular handling tool may comprise supplying pressurized fluid to a plurality of first chambers of a volume synchronizer, each of the first chambers being separated from a second chamber by a piston, each of the pistons being connected together by a rod member; simultaneously supplying a substantially equal amount of pressurized fluid from each of the second chambers to a plurality of piston cylinders of the tubular handling tool; and simultaneously actuating slips of the tubular handling tool into engagement with a tubular string.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
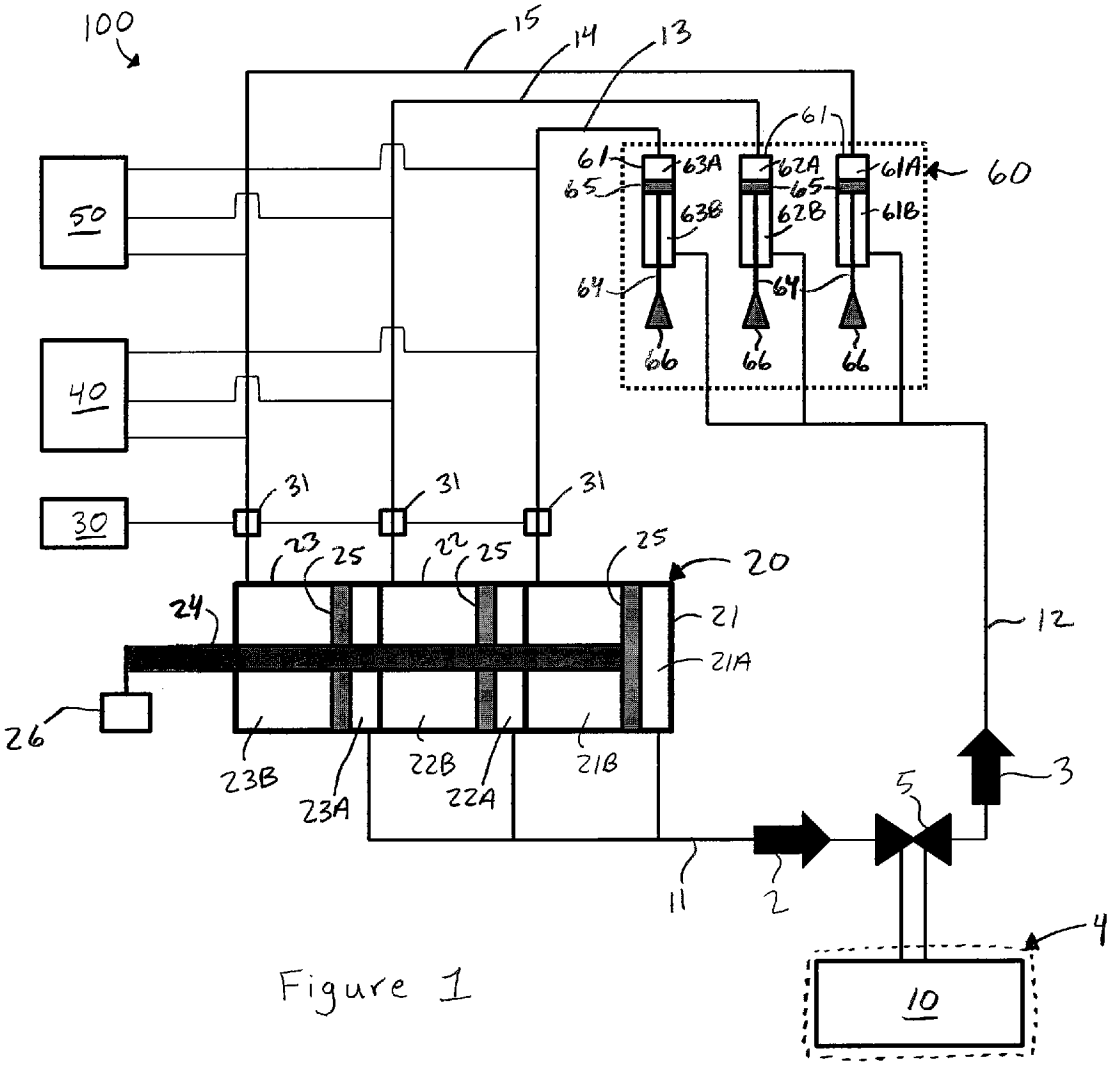
FIG. 1 illustrates a control system for actuating a tubular handling tool, shown in a first position, according to one embodiment.

FIG. 1 illustrates a control system 100 for controlling the operation of a tubular handling tool 60. The control system 100 controls the supply of fluid to a plurality of piston cylinders 61 to synchronize the actuation of a plurality of slips 66 of the tubular handing tool 60. The tubular handling tool 60 may include any type of spider, elevator, tong, and/or articulating arm device known in the art. One example of a tubular handling tool 60 is the wedge device 1 disclosed in U.S. Pat. No. 7,980,298, the contents of which are herein incorporated by reference. Another example of a tubular handling tool 60 is the apparatus 101 having arms 109, 114, 115 disclosed in U.S. Pat. No. 6,591,471, the contents of which are herein incorporated by reference. The control system 100 may be configured to control the operation of other fluid actuated tools known in the art.

The control system 100 includes a control unit 4 comprising a fluid source 10 configured to supply and receive fluid to and from the tubular handling tool 60 and a volume synchronizer 20. The control unit 4 may comprise one or more control panels (including key pads, switches, knobs, touch pads, etc.), valves, and/or additional control and fluid lines configured to communicate with, monitor, and control the operation of the components of the control system 100, including valve 5, volume synchronizer 20, tubular handling tool 60, sensors 26, 31, relieve valve 30, fluid inlet 40, and fluid outlet 50. The control unit 4 may be equipped with a programmable central processing unit, a memory, a mass storage device, and well-known support circuits such as power supplies, clocks, cache, input/output circuits and the like.

The control unit 4 may actuate a valve 5, such as a solenoid valve, that controls the flow of fluid to and from the tubular handling tool 60 and the volume synchronizer 20. As illustrated by reference arrow 2 in FIG. 1, fluid from (first) chambers 21A, 22A, 23A of the volume synchronizer 20 is returned to the fluid source 10 via fluid line 11. As illustrated by reference arrow 3 in FIG. 1, fluid from the fluid source 10 is supplied to (second) chambers 61B, 62B, 63B of the piston cylinders 61 of the tubular handling tool 60 via fluid line 12.

Each slip 66 of the tubular handling tool 60 is connected to a piston 65 disposed in each piston cylinder 61 by a rod member 64. Pressurized fluid supplied to the chambers 61B, 62B, 63B moves the pistons 65 to move the slips 66 in unison into a first position, such as a retracted or open position where the slips 66 do not engage a tubular string disposed in or adjacent the tubular handling tool 60. At the same time, the pistons 65 force fluid out of (first) chambers 61A, 62A, 63A and into the fluid lines 13, 14, 15 that are respectively connected to each chamber. The fluid lines 13, 14, 15 are in fluid communication with (second) chambers 21B, 22B, 23B of the volume synchronizer 20.

The volume synchronizer 20 includes a body, such as a piston cylinder, having one or more chambers. As illustrated, three chambers 21, 22, 23 are fluidly isolated from each other. A piston 25 is disposed in each chamber 21, 22, 23, separating first chambers 21A, 22A, 23A and second chambers 21B, 22B, 23B. Each piston 25 is coupled to a single rod member 24 so that all of the pistons 25 move in unison, e.g. together as a unit. The rod member 24 is movable and extends through one or more of the chambers 21, 22, 23 and out of the body of the volume synchronizer 20. One or more seals may be disposed between the rod member 24 and the body of volume synchronizer 20 to prevent leakage out of the body and between the chambers 21, 22, 23. The pistons 25 are coupled to the rod member 24 and positioned within the chambers 21, 22, 23 such that the chambers 21A, 22A, 23A have substantially equal volumes, and such that the chambers 21B, 22B, 23B also have substantially equal volumes. In one embodiment, one or more of the chambers 21A, 22A, 23A and/or 21B, 22B, 23B may have substantially different volumes than the other chambers. In one embodiment, the volume synchronizer 20 may be positioned adjacent to or within the control unit 4 and/or fluid source 10. In other embodiments, the volume synchronizer 20 may be positioned adjacent to or within the tubular handling tool 60, or at any other location between the tubular handling tool 60 and the control unit 4 and/or fluid source 10.

Pressurized fluid supplied to the chambers 21B, 22B, 23B via fluid lines 13, 14, 15, respectively, moves the pistons 25 and the rod member 24 in unison into a first position, such as a retracted or open position. At the same time, the pistons 25 force fluid out of the chambers 21A, 22A, 23A and into the fluid line 11 that is connected to each chamber 21A, 22A, 23A. The fluid in the fluid line 11 is returned to the fluid source 10 through the valve 5 as illustrated by reference arrow 2 in FIG. 1.

The fluid lines 13, 14, 15 provide fluid communication between chambers 21B, 22B, 23B of the volume synchronizer 20 and chambers 63A, 62A, 61A, respectively, of the piston cylinders 61 of the tubular handling tool 60. Although illustrated as having different lengths, each of the fluid lines 13, 14, 15 may have substantially the same length. The volume synchronizer 20 via the fluid lines 13, 14, 15 synchronizes the timing and amount of pressurized fluid that is supplied to each piston cylinder 61 of the tubular handling tool 60 to synchronize the actuation of the slips 66.

A relief valve 30 may be in fluid communication with the fluid lines 13, 14, 15 to release fluid from the lines in the event that the pressure in the fluid lines 13, 14, 15 exceeds a predetermined amount. One or more sensors 31, such as pressure transducers, may be coupled to each line to measure and monitor the pressure in the fluid lines 13, 14, 15. In one embodiment, one or more of the sensors 31 may measure and monitor the amount of fluid flow out of the chambers 21B, 22B, 23B, into the chambers 61A, 62A, 63A, and/or through at least a portion of the fluid lines 13, 14, 15. The sensors 31 may be positioned near the outlet of the chambers 21B, 22B, 23B, near the inlet of the chambers 61A, 62A, 63A, and/or at any other intermediate location along the fluid lines 13, 14, 15. A fluid inlet 40 having one or more valves that may be used to fill or refill the fluid lines 13, 14, 15, the pistons 61, and/or the volume synchronizer 20 with fluid, e.g. liquid or gas. A fluid outlet 50 having one or more valves that may be used to remove or bleed fluid, e.g. liquid or gas, from the fluid lines 13, 14, 15, the pistons 61, and/or the volume synchronizer 20. A sensor 26 may be used to measure and monitor the position of the rod member 24 to provide an indication of the operational position of the volume synchronizer 20. In one embodiment, the sensor 26 may include a position indicator contacting the rod member 24 to continuously measure and monitor the exact location of the rod member 24, thereby providing an indication of the operational position of the volume synchronizer 20. In one embodiment, the sensor 26 may include one or more position sensors arranged to measure and monitor discrete positions (such as an initial, intermediate, and/or final position) of the rod member 24, thereby providing an indication of the operational position of the volume synchronizer 20.

Figure 2:
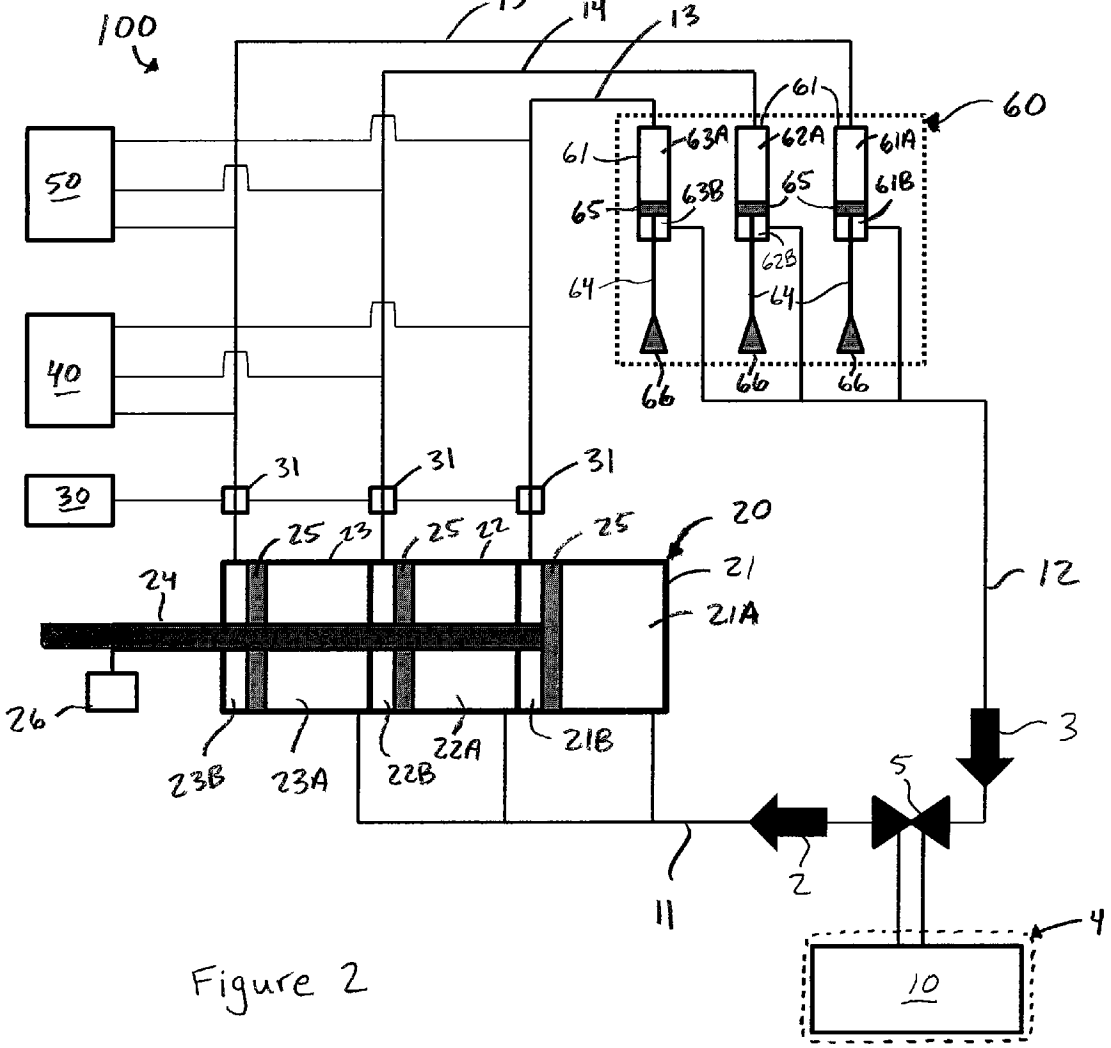
FIG. 2 illustrates the control system for actuating the tubular handling tool, shown in a second position, according to one embodiment.

Referring to FIG. 2, as illustrated by reference arrow 2, fluid from the fluid source 10 is supplied to chambers 21A, 22A, 23A of the volume synchronizer 20 via fluid line 11. Pressurized fluid supplied to the chambers 21A, 22A, 23A moves the pistons 25 and the rod member 24 in unison into a second position, such as an extended or closed position. At the same time, the pistons 25 force pressurized fluid out of the chambers 21B, 22B, 23B and into the fluid line 13, 14, 15 that is connected to each chamber. The pressurized fluid from each fluid line 13, 14, 15 is supplied to each chamber 63A, 62A, 61A, respectively, of the pistons 61 of the tubular handling tool 60.

Pressurized fluid supplied to the chambers 63A, 62A, 61A moves the pistons 65 to move the slips 66 in unison into a second position, such as an extended or closed position where the slips 66 engage a tubular string disposed in or adjacent the tubular handling tool 60. At the same time, the pistons 65 force fluid out of the chambers 61B, 62B, 63B and into the fluid line 12 that is connected to each chamber. The fluid in the fluid line 12 is returned to the fluid source 10 through the valve 5 as illustrated by reference arrow 3 in FIG. 2.

The volume synchronizer 20 is configured to simultaneously supply a substantially equal amount of fluid to each piston 61 of the tubular handling tool 60 to synchronize the movement of the slips 66 into engagement with a tubular string. The slips 66 may be uniformly positioned around the tubular string. Actuation of by the slips 66 using the volume synchronizer 20 will ensure that the tubular is properly engaged and supported by the slips 66 of the tubular handling tool 60.

As illustrated in FIG. 2, the rod member 24 may engage the sensor 26. The sensor 26 may provide verification that the tubular handling tool 60 has been actuated into a fully closed position by the volume synchronizer 20. In particular, contact between the rod member 24 and the sensor 26 may provide an indication that the pistons 25 in the volume synchronizer 20 have moved a distance sufficient to force a predetermined amount of pressurized fluid into the chambers 61A, 62A, 63A of the tubular handling tool 60 to actuate the slips 66.

Figure 3:
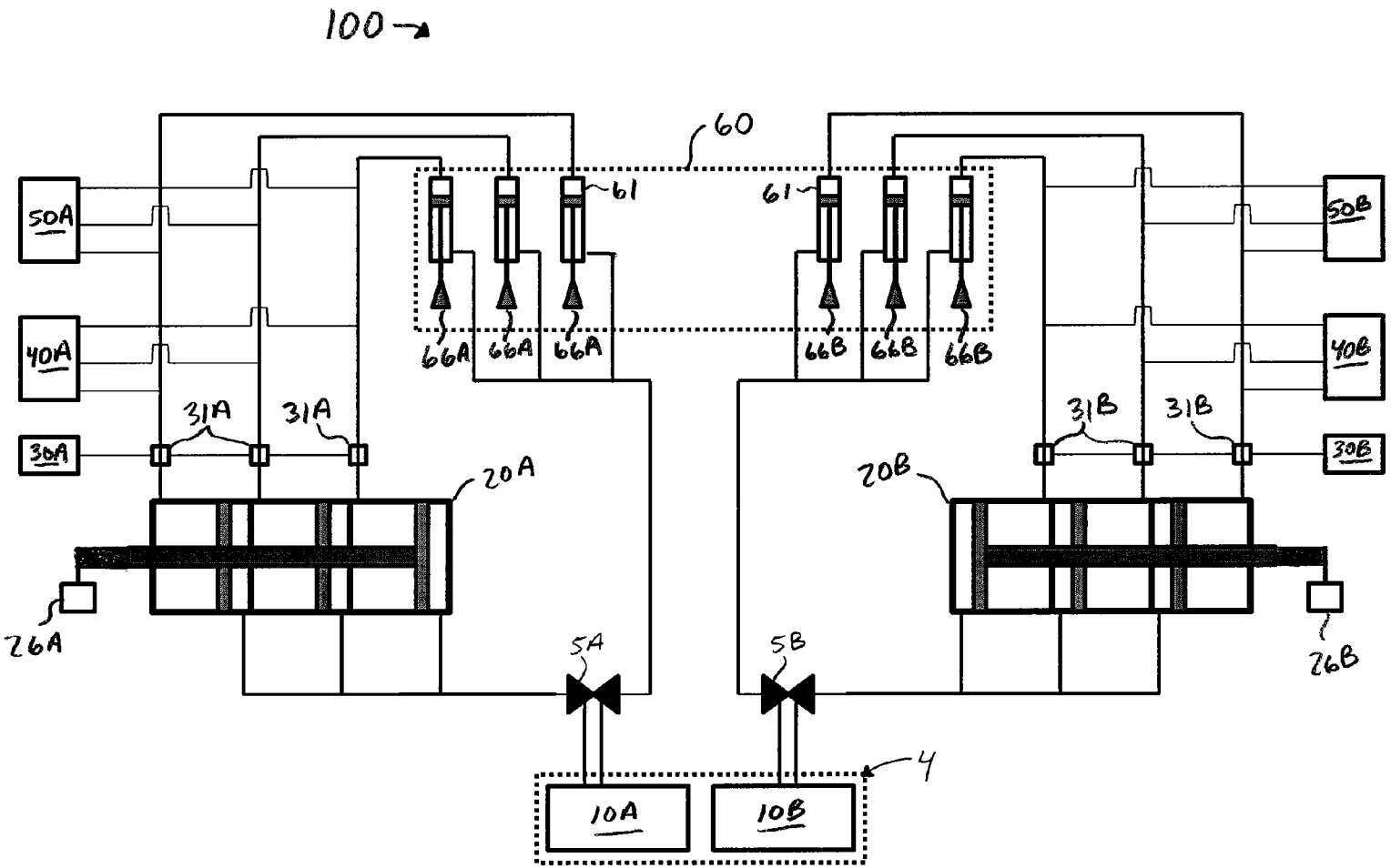
FIG. 3 illustrates the control system for actuating the tubular handling tool, according to one embodiment.

FIG. 3 illustrates the control system 100 controlling the actuation of two (first and second) sets of slips 66A, 66B of a tubular handling tool 60 via two volume synchronizers 20A, 20B. The control unit 4 may include two fluid sources 10A, 10B, or may include a single fluid source, configured to supply fluid to the volume synchronizers 20A, 20B and receive fluid from the piston cylinders 61 of the tubular handling tool 60. The control unit 4 may be configured to communicate with, monitor, and control the operation of the components of the control system 100, including valves 5A, 5B, volume synchronizers 20A, 20B, tubular handling tool 60, sensors 26A, 26B, 31A, 31B, relieve valves 30A, 30B, fluid inlets 40A, 40B, and fluid outlets 50A, 50B.

In operation, the control system 100 may be configured to synchronize the actuation of only the slips 66A to grip and support a tubular string having one outer diameter size, and configured to synchronize the actuation of only the slips 66B to grip and support a tubular string having different outer diameter size. The slips 66A may be configured to grip and support tubular strings within one range of outer diameter sizes, while the slips 66B may be configured to grip and support tubular strings within a different range of outer diameter sizes. The control system 100 may be configured to synchronize the actuation of all six slips 66A, 66B simultaneously to grip and support a tubular string.

Figure 4:
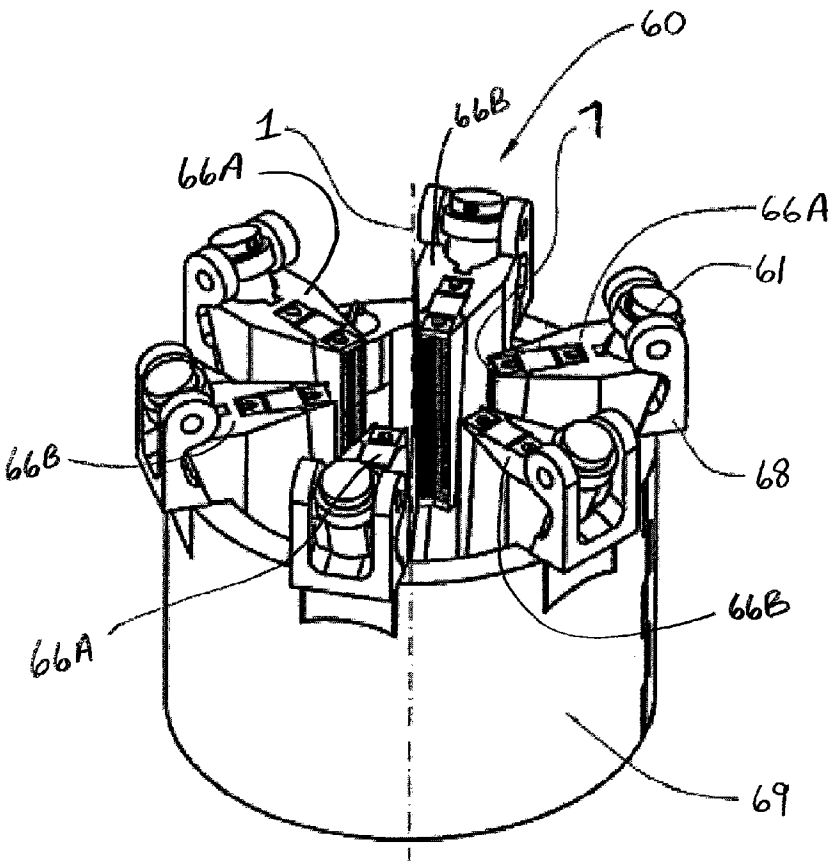
FIG. 4 illustrates the tubular handling tool, according to one embodiment.

FIG. 4 illustrates one embodiment of the tubular handling tool 60. The tubular handling tool 60 includes the plurality of slips 66A, 66B, each having gripping surfaces 7 for engaging a tubular string disposed along or adjacent the central axis 1 of the tubular handling tool 60. The piston cylinders 61 are configured to extend and retract the slips 66A, 66B into and out of engagement with the tubular string. The slips 66A, 66B are supported by support members 68, which are coupled to a housing 69, also known as a bowl, of the tubular handling tool 60.

Figure 6:
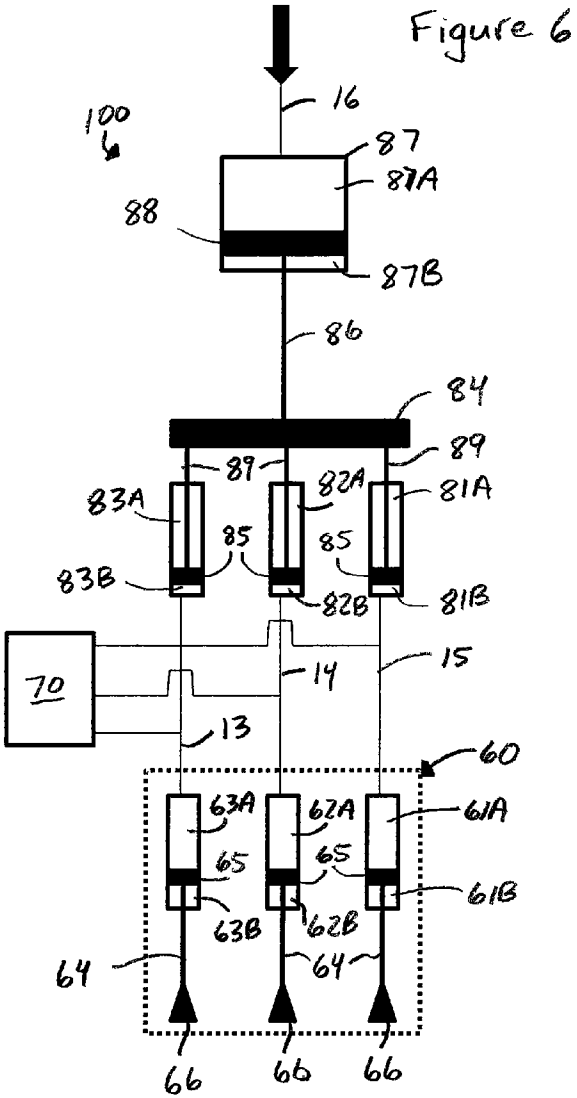
FIG. 6 illustrates the control system for actuating the tubular handling tool, shown in a second position, according to one embodiment.
Figure 5:
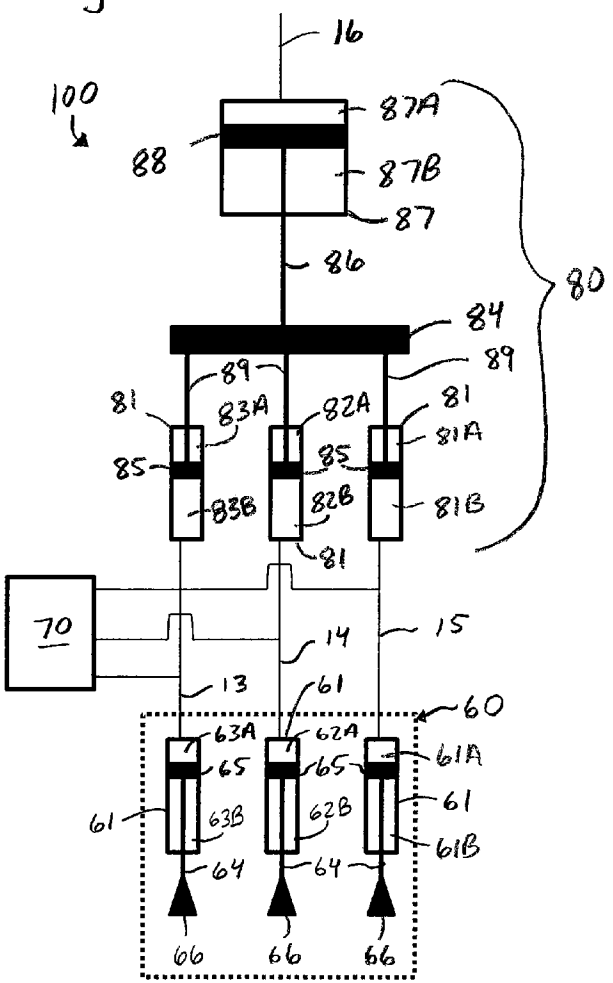
FIG. 5 illustrates a control system for actuating a tubular handling tool, shown in a first position, according to one embodiment.

FIGS. 5 and 6 illustrate the control system 100 according to another embodiment. One or more of the components of the control system 100 illustrated in FIGS. 1, 2, 3, and 4 may be used with the embodiments of the control system 100 illustrated in FIGS. 5 and 6. Similar components may be identified with the same reference numerals.

FIG. 5 illustrates a volume synchronizer 80 configured to synchronize the supply of substantially equal amounts of fluid to the piston cylinders 61 of the tubular handling tool 60. The volume synchronizer 80 includes three piston cylinders 81 having chambers 83B, 82B, 81B that are in fluid communication with chambers 63A, 62A, 61A of the three piston cylinders 61 of the tubular handling tool 60 via fluid lines 13, 14, 15, respectively. The volume synchronizer 80 and the tubular handling tool 60 may be configured with one, two, three, or more piston cylinders.

One or more control valves 70 may be used to provide fluid communication to the fluid lines 13, 14, 15. The control valve 70 may operate similar to the relief valve 30, the fluid inlet 40, and/or the fluid outlet 50. The control valve 70 may be configured to relieve, fill, and/or remove fluid from, as well as monitor the fluid pressure in, the fluid lines 13, 14, 15, the chambers 83B, 82B, 81B, and/or the chambers 63A, 62A, 61A.

A piston 85 may be disposed in each piston cylinder 81, and each piston 85 may be connected to a plate member 84 via rod members 89. The plate member 84 also may be connected to a piston 88 disposed in another piston cylinder 87 by a rod member 86. Any number of rod members 86, 89 may be used. A chamber 87A of the piston cylinder 87 may be in fluid communication with a fluid line 16. The fluid line 16 may supply pressurized fluid to the chamber 87A from a fluid source, such as the fluid source 10 of the control unit 4 illustrated in FIGS. 1 and 2.

In FIG. 5, the volume synchronizer 80 and the tubular handling tool 60 may be in a first position, such as a retracted or open position, where the slips 66 do not engage a tubular string disposed in or adjacent the tubular handling tool 60.

In FIG. 6, the volume synchronizer 80 and the tubular handling tool 60 may be in a second position, such as an extended or closed position, where the slips 66 engage a tubular string disposed in or adjacent the tubular handling tool 60. In particular, pressurized fluid (such as from the fluid source 10) is supplied to chamber 87A via fluid line 16 to move the piston 88 and the rod member 86 in a direction toward the piston cylinders 81. The rod member 86 moves the plate member 84, and at the same time, moves the pistons 85 via rod members 89 in unison to force pressurized fluid out of the chambers 81B, 82B, 83B and into the fluid line 13, 14, 15 that is connected to each chamber. The pressurized fluid from each fluid line 13, 14, 15 is supplied to each chamber 63A, 62A, 61A, respectively, of the pistons 61 of the tubular handling tool 60 to actuate the slips 66 in unison.

Pressurized fluid supplied to the chambers 63A, 62A, 61A moves the pistons 65 to move the slips 66 in unison into the second position, such as the extended or closed position where the slips 66 engage a tubular string disposed in or adjacent the tubular handling tool 60. At the same time, the pistons 65 may compress and/or force fluid out of the chambers 61B, 62B, 63B, which fluid may be returned to the fluid source 10 for example. Similarly, pressurized fluid may be supplied into the chambers 61B, 62B, 63B to retract the slips 66 in unison and move the tubular handling tool 60 and the volume synchronizer 80 back into the first position, such as the retracted or open position. The chambers 81A, 82A, 83A may be empty or may include a compressible fluid.

The volume synchronizer 80 is configured to simultaneously supply substantially equal amount of fluid to each piston cylinder 61 of the tubular handling tool 60 to synchronize the movement of the slips 66 into engagement with a tubular string. The slips 66 may be uniformly positioned around the tubular string. Actuation of the slips 66 using the volume synchronizer 20 will ensure that the tubular string is properly engaged and supported by the slips 66 of the tubular handling tool 60. In one embodiment, the control system 100 may include a plurality of volume synchronizers 80. One volume synchronizer 80 may be configured to supply pressurized fluid only to a first set of piston cylinders 61 having slips 66A, and another volume synchronizer 80 may be configured to supply pressurized fluid only to a second set of piston cylinders 61 having slips 66B of the tubular handling tool 60 illustrated in FIG. 4.

Figure 7:
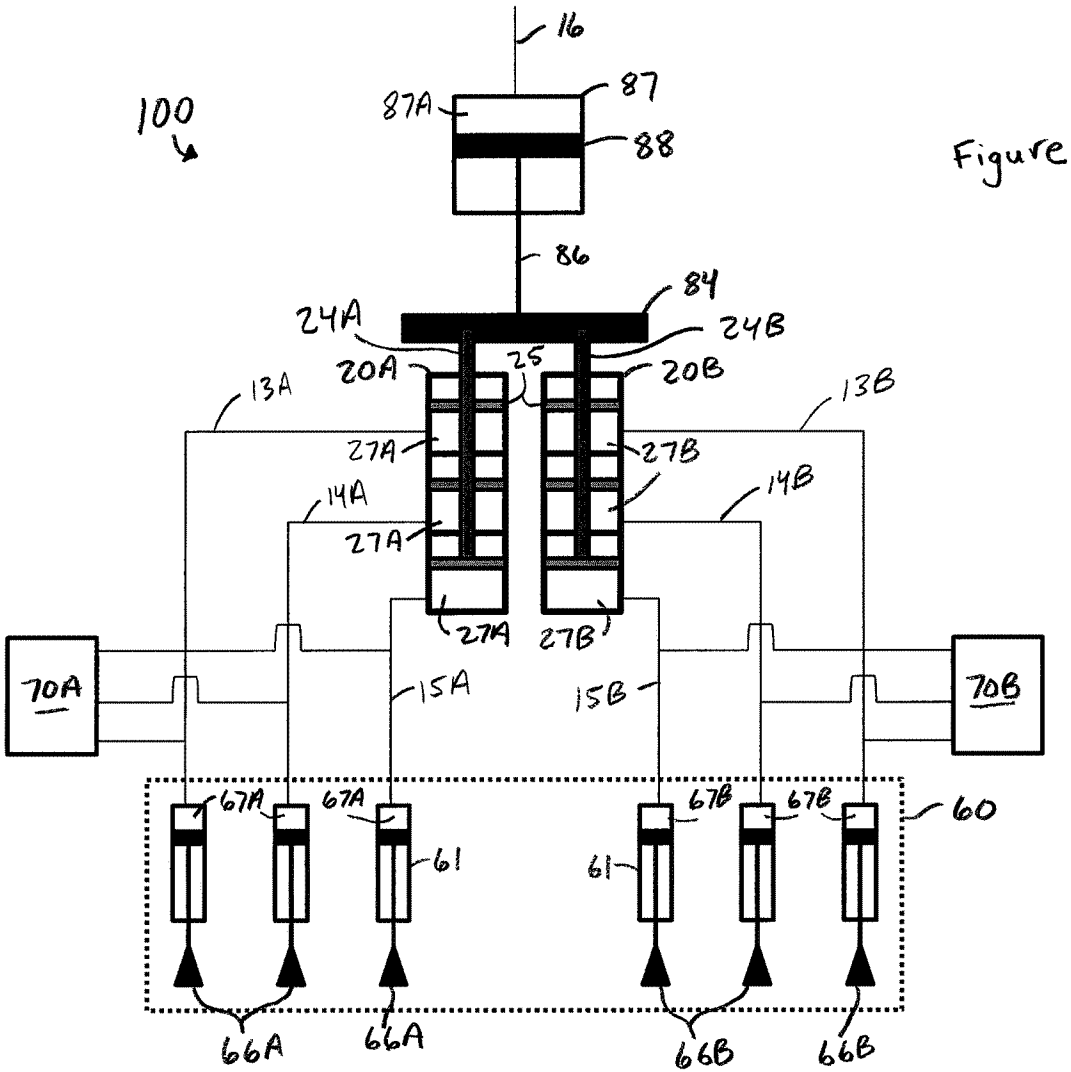
FIG. 7 illustrates a control system for actuating a tubular handling tool, according to one embodiment.

FIG. 7 illustrate the control system 100 according to another embodiment. One or more of the components of the control systems 100 illustrated in FIGS. 1, 2, 3, 4, 5, and 6 may be used with the embodiments of the control system 100 illustrated in FIG. 7. Similar components may be identified with the same reference numerals.

In FIG. 7, pressurized fluid (such as from the fluid source 10 of control unit 4) is supplied to chamber 87A via fluid line 16 to move the piston 88 and the rod member 86 in a direction toward volume synchronizers 20A, 20B (e.g. piston cylinders). The rod member 86 moves the plate member 84, and at the same time, moves the pistons 25 via rod members 24A, 24B in unison to force pressurized fluid out of the chambers 27A, 27B and into the fluid line 13A, 13B, 14A, 14B, 15A, 15B that is connected to each chamber. The pressurized fluid from each fluid line 13A, 13B, 14A, 14B, 15A, 15B is supplied to each chamber 67A, 67B, respectively, of the pistons 61 of the tubular handling tool 60 to actuate the slips 66A, 66B in unison. The control valves 70A, 70B may be configured to relieve, fill, and/or remove fluid from, as well as monitor the fluid pressure in, the fluid lines 13A, 13B, 14A, 14B, 15A, 15B and the chambers 67A, 67B, respectively.

In one embodiment, only one volume synchronizer 20A or 20B may be used to supply fluid to each of the chambers 67A, 67B. The one volume synchronizer 20A or 20B may include six chambers configured to supply fluid to the six piston cylinders 61 of the tubular handling tool 60. The one volume synchronizer 20A or 20B may include three chambers, each chamber configured to supply fluid to at least two chambers 67A, 67B of the piston cylinders 61 of the tubular handling tool 60.

While the foregoing is directed to embodiments of the invention, other and further embodiments of the invention may be devised without departing from the basic scope thereof, and the scope thereof is determined by the claims that follow.

The invention claimed is:

1. A control system, comprising:
- a fluid source;
- a tubular handling tool having a plurality of piston cylinders and a plurality of slips configured to engage a tubular string;
- a volume synchronizer comprising:
  - a plurality of first chambers in fluid communication with the fluid source;
  - a plurality of second chambers in fluid communication with the piston cylinders;
  - a piston separating each of the first and second chambers;
  - a rod member connected to each piston;
- wherein pressurized fluid supplied to the first chambers simultaneously moves each of the pistons, thereby forcing pressurized fluid out of the second chambers and simultaneously into the piston cylinders of the tubular handling tool, thereby actuating the slips into engagement with the tubular string;
- wherein each of the piston cylinders of the tubular handling tool include a piston separating a first chamber from a second chamber of the piston cylinder; and
- a valve configured to control fluid communication from the fluid source to the first chambers of the volume synchronizer, and from the fluid source to the second chambers of the piston cylinders.

2. The control system of claim 1, wherein a substantially equal amount of fluid is supplied from each of the second chambers of the volume synchronizer to each of the piston cylinders to move the slips in unison and into engagement with the tubular string.

3. The control system of claim 1, wherein each piston of the tubular handling tool is connected to a slip by a rod member.

4. The control system of claim 3, wherein each one of the second chambers of the volume synchronizer is in fluid communication with only one of the first chambers of the piston cylinders, and wherein each one of the first chambers of the piston cylinders is in fluid communication with only one of the second chambers of the volume synchronizer.

5. The control system of claim 4, wherein the second chambers of the t piston cylinders are in fluid communication with the fluid source.

6. The control system of claim 1, further comprising a fluid inlet and a fluid outlet configured to fill and remove fluid from the second chambers of the volume synchronizer and the first chambers of the piston cylinders.

7. The control system of claim 1, further comprising a sensor configured to provide an indication of a position of the rod member of the volume synchronizer.

8. The control system of claim 1, further comprising another volume synchronizer in fluid communication with another plurality of piston cylinders of the tubular handling tool to simultaneously actuate another plurality of slips of the tubular handling tool.

9. The control system of claim 1, wherein the tubular handling tool comprises a spider, an elevator, a tong, or an articulating arm device.

10. A control system, comprising:
- a tubular handling tool having a plurality of piston cylinders and a plurality of slips configured to engage a tubular string;
- a volume synchronizer comprising:
  - a first piston cylinder having a piston connected to a first rod member;
  - a plate member connected to the first rod member; and
  - a plurality of second piston cylinders, each having a piston connected to the plate member by a plurality of second rod members;
- wherein pressurized fluid supplied to the first piston cylinder moves the plate member to move each of the pistons in the second piston cylinders, thereby forcing pressurized fluid out of the second piston cylinders and simultaneously into the piston cylinders of the tubular handling tool, thereby actuating the slips into engagement with the tubular string; and
- a control valve configured to fill or remove fluid from the second piston cylinders of the volume synchronizer, and from the piston cylinders of the tubular handling tool.

11. The control system of claim 10, wherein each of the piston cylinders of the tubular handling tool include a piston separating a first chamber from a second chamber of the piston cylinder.

12. The control system of claim 11, wherein each piston of the tubular handling tool is connected to a slip by a rod member.

13. The control system of claim 12, wherein each one of the second piston cylinders of the volume synchronizer is in fluid communication with only one of the piston cylinders of the tubular handling tool, and wherein each one of the piston cylinders of the tubular handling tool is in fluid communication with only one of the second piston cylinders of the volume synchronizer.

14. The control system of claim 10, wherein each of the second piston cylinders comprises a plurality of chambers, each chamber having a piston separating the chamber into first chambers and second chambers.

15. The control system of claim 14, wherein one of the second piston cylinders of the volume synchronizer is configured to actuate a first set of slips of the tubular handling tool, and another one of the second piston cylinders of the volume synchronizer is configured to actuate a second set of slips of the tubular handling tool.

16. The control system of claim 10, wherein a substantially equal amount of fluid is supplied from each of the second piston cylinders of the volume synchronizer to each of the piston cylinders of the tubular handling tool to move the slips in unison and into engagement with the tubular string.

17. The control system of claim 10, wherein the tubular handling tool comprises a spider, an elevator, a tong, or an articulating arm device.

18. A method of actuating a tubular handling tool, comprising:

supplying pressurized fluid from a fluid source to a plurality of first chambers of a volume synchronizer, each of the first chambers being separated from a second chamber by a piston, each of the pistons being connected together by a rod member;

simultaneously supplying a substantially equal amount of pressurized fluid from each of the second chambers to a plurality of piston cylinders of the tubular handling tool, wherein each of the piston cylinders of the tubular handing tool includes a piston separating a first chamber and a second chamber of the piston cylinder, each piston coupled to a slip by a rod member;

simultaneously actuating slips of the tubular handling tool into engagement with a tubular string; and actuating a valve that controls fluid communication from the fluid source to the first chambers of the volume synchronizer, and from the fluid source to the second chambers of the piston cylinders.

19. The method of claim 18, further comprising simultaneously supplying pressurized fluid from each of the second chambers of the volume synchronizer to each of the first chambers of the piston cylinders, and returning fluid from the second chambers of the piston cylinders to the fluid source.

20. The method of claim 19, further comprising actuating a first set of slips of the tubular handling tool using the volume synchronizer, and actuating a second set of slips of the tubular handling tool using another volume synchronizer.

21. The method of claim 18, wherein the tubular handling tool comprises a spider, an elevator, a tong, or an articulating arm device.

* * * * *